US006993945B1

(12) United States Patent
Chen

(10) Patent No.: US 6,993,945 B1
(45) Date of Patent: Feb. 7, 2006

(54) DOORKNOB WITH A LOCK

(76) Inventor: Jeff Chen, No. 333, Wufong N. Rd., Chiayi (TW)

( * ) Notice: Subject to any disclaimer, the term of this patent is extended or adjusted under 35 U.S.C. 154(b) by 0 days.

(21) Appl. No.: 10/980,666

(22) Filed: Nov. 3, 2004

(51) Int. Cl.
*E05B 13/10* (2006.01)

(52) U.S. Cl. ..... 70/472; 70/149; 70/222; 70/224; 292/DIG. 27

(58) Field of Classification Search ..... 70/188, 70/189, 215–218, 472, 473, 221–224, 149, 70/422, DIG. 31; 292/DIG. 27, 169.21, 292/169.22, 169.23
See application file for complete search history.

(56) References Cited

U.S. PATENT DOCUMENTS 3,035,432 A * 5/1962 De Vines ..... 70/216
3,196,644 A * 7/1965 Russell et al. ..... 70/224
3,212,306 A * 10/1965 Russell et al. ..... 70/224
3,269,158 A * 8/1966 Andre ..... 70/216
3,556,576 A * 1/1971 Nelson et al. ..... 292/359
5,301,526 A * 4/1994 Fann et al. ..... 70/224
5,927,777 A * 7/1999 Kuo et al. ..... 292/358
6,360,569 B1 * 3/2002 Huang ..... 70/215
6,470,721 B2 * 10/2002 Ming ..... 70/224
6,543,265 B1 * 4/2003 Fan ..... 70/224
6,807,833 B1 * 10/2004 Huang et al. ..... 70/107
2004/0237608 A1 * 12/2004 Chen ..... 70/224

* cited by examiner

*Primary Examiner*—Lloyd A. Gall
(74) *Attorney, Agent, or Firm*—Jackson Walker, LLP

(57) ABSTRACT

The doorknob with a lock has a bolt assembly, a lock activating assembly, an outer doorknob assembly and an inner doorknob assembly. The bolt assembly is mounted in a door and has a bolt head and a rotatable plug. The lock activating assembly has a base, a head, an outer clutch plate and an inner clutch plate. The base and the head respectively have an annular longitudinal protrusion, and the base is covered by the annular longitudinal protrusion. Each annular longitudinal protrusion has two opposite gaps. The outer and inner clutch plates respectively have a long protruding end, a short end, a longitudinal slot and a transverse slot. The ends of the clutch plates are slidably mounted in the gaps in the annular longitudinal protrusion, and the long protruding ends selectively engage the gaps in the annular longitudinal protrusion to lock and unlock the door.

5 Claims, 7 Drawing Sheets

DOORKNOB WITH A LOCK

BACKGROUND OF THE INVENTION

1. Field of the Invention

The present invention relates to a doorknob with a lock, especially to a doorknob with a lock that does not lock the inside handle.

2. Description of the Prior Art

Generally speaking, doorknobs are usually locked and unlocked with keys from outside of rooms. When people are inside rooms, different kinds of conventional doorknobs lock and unlock in different ways. When people are inside a room, one conventional doorknob is locked or unlocked by rotating a control knob. Therefore when the doorknob is locked, a user inside the room has to rotate the control knob and turn the doorknob to open the door. However, a small child may not know how or be unable to unlock the door in an emergency by rotating the control knob and cannot get out of the room. The child not being able to leave the room quickly could be disastrous.

To overcome the shortcomings, the present invention provides a doorknob with a lock that does not lock the inside handle of a doorknob to mitigate or obviate the aforementioned problems.

SUMMARY OF THE INVENTION

The main objective of the present invention is to provide a doorknob with a lock that is easy to open when inside a room.

The doorknob with a lock in accordance with the present invention comprises a bolt assembly, a lock activating assembly, an outer doorknob assembly and an inner doorknob assembly. The bolt assembly is mounted in a door and has a bolt head and a rotatable plug. The lock activating assembly has a base, a head, an outer clutch plate and an inner clutch plate. The base and the head respectively have an annular longitudinal protrusion, and the base is covered in the annular longitudinal protrusion on the head. Each annular longitudinal protrusion has two opposite gaps. The outer and inner clutch plates respectively have two ends and a longitudinal and transverse hole. The ends of the clutch plates engage the gaps in the base and selectively engage the gaps in the head to lock and unlock the door.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
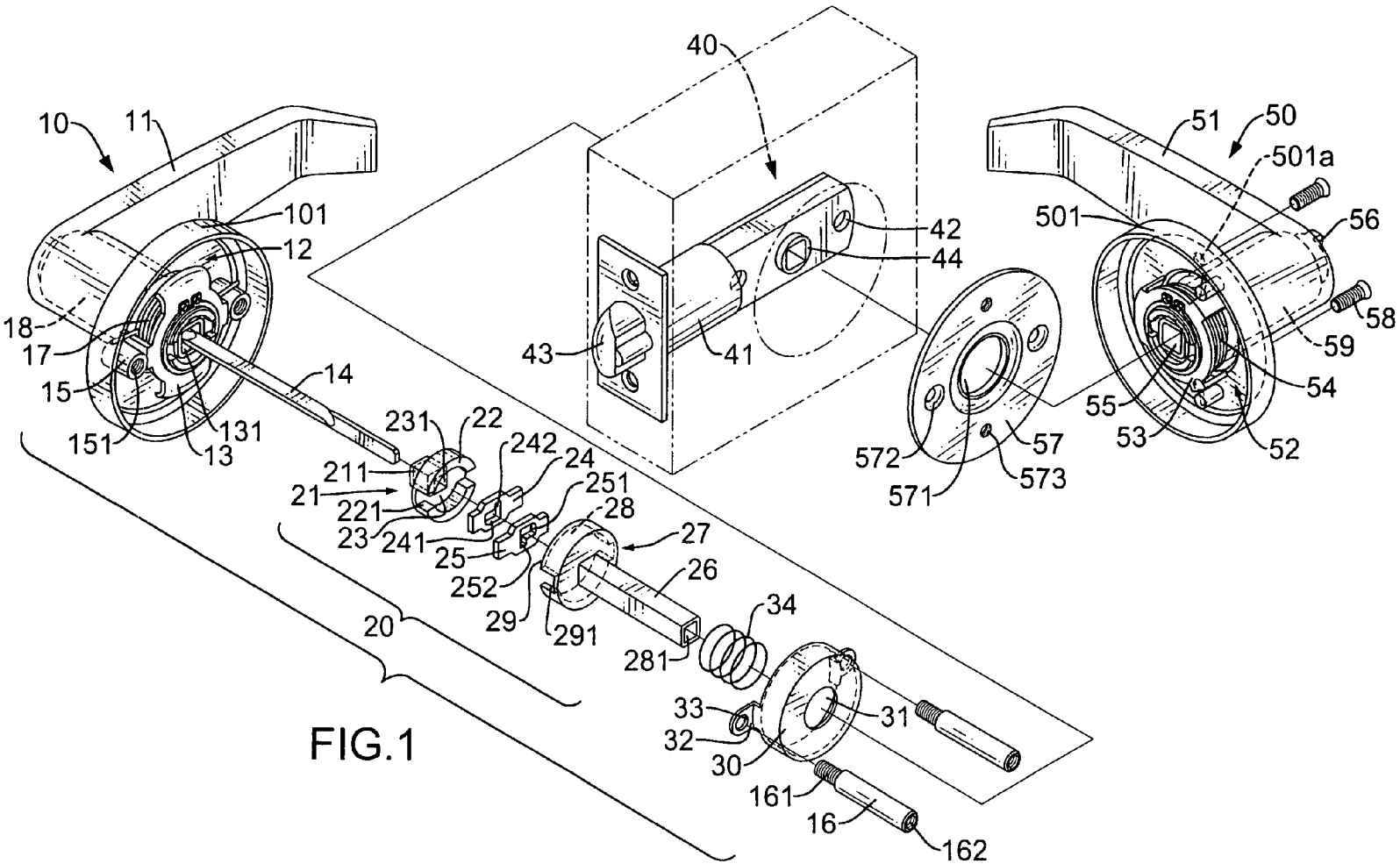
FIG. 1 is an explode perspective view of a doorknob with a lock in accordance with the present invention.
Figure 2:
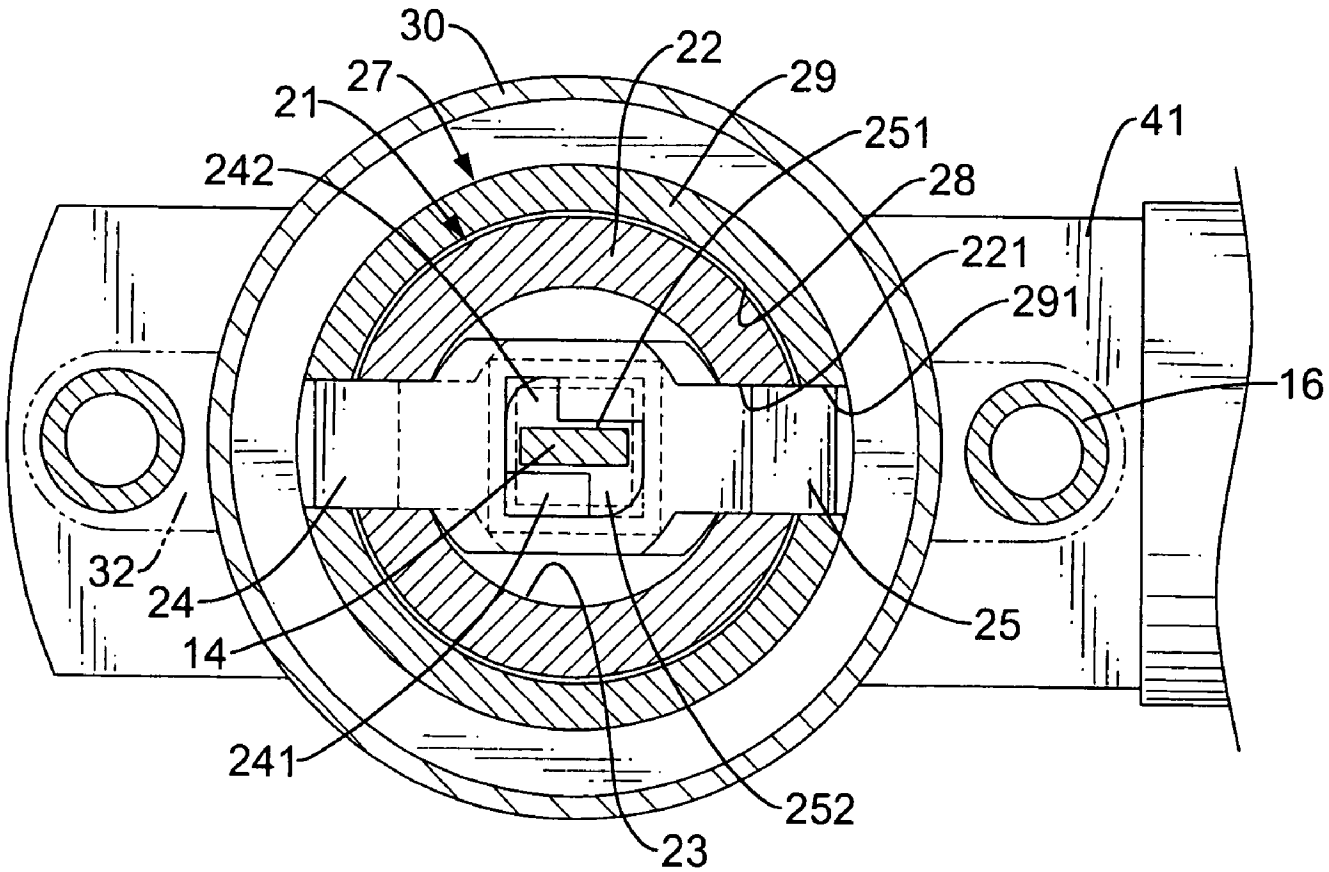
FIG. 2 is a front view in partial section of the doorknob in FIG. 1.

With reference to FIGS. 1 and 2, a doorknob with a lock in accordance with the present invention comprises a bolt assembly (40), an optional housing (30), a lock activating assembly (20), an outer doorknob assembly (10), an inner doorknob assembly (50) and multiple optional fasteners (16). The doorknob is mounted in a door that has an inner surface and an outer surface.

The bolt assembly (40) is mounted in the door and has a bolt (41), a bolt head (43), a rotatable plug (44) and multiple optional fastening holes (42). The bolt (41) is mounted in the door and has a distal end and a proximal end. The bolt head (43) is formed on the distal end of the bolt (41) and protrudes out of the door. The rotatable plug (44) is circular, has a non-circular through hole and is mounted rotatably through the bolt (41) near the proximal end of the bolt (41). The fastening holes (42) are formed around the rotatable plug (44).

The housing (30) has an inner surface, an outer surface, an edge, a through hole (31) and two ears (32). The inner surface is attached to the outer surface of the door. The through hole (31) is formed through the housing (30) and aligns with the non-circular through hole in the rotatable plug (44). The ears (32) are formed on the outer surface and the edge of the housing (30), are opposite to each other and respectively have a fastening hole (33). The fastening holes (33) are formed through the ears (32) and respectively correspond to the fastening holes (42) in the bolt assembly (40).

The lock activating assembly (20) has a lock activator, a base (21), an outer clutch plate (24) and an inner clutch plate (25).

The lock activator has a locking tube (26), a head (27) and an optional spring (34). The locking tube (26) is non-circular, corresponds to and is mounted through the non-circular through hole in the rotatable plug (44) and has a proximal end, a distal end and a central through hole. The head (27) is formed on the proximal end of the locking tube (26) and has an outer surface, an edge, a through hole (281) and an annular longitudinal protrusion (29). The through hole (281) is formed through the head (27) and corresponds to the central through hole in the locking tube (26). The annular longitudinal protrusion (29) is formed on the edge and the outer surface of the head (27), forms an open cavity (28) and has two opposite gaps (291). The spring (34) is mounted around the locking tube (26) and is compressed by the head (27) and the housing (30).

The base (21) corresponds to the open cavity (28) in the head (27) and has an outer surface, an inner surface, an edge, a non-circular neck (211), a through hole (231) and an annular longitudinal protrusion (22). The non-circular neck (211) is hollow and is formed concentrically on the outer surface of the base (21). The through hole (231) is formed through the base (21) and corresponds to the non-circular neck (211). The annular longitudinal protrusion (22) is formed on the inner surface and the edge of the base (21), forms an open cavity (23) and has two opposite gaps (221). The gaps (221) in the annular longitudinal protrusion (22) of the base (21) correspond to the gaps (291) in the annular longitudinal protrusion (29) of the head (27).

The outer and inner clutch plates (24, 25) are mounted in the open cavity (23) of the base (21), and each clutch plate (24, 25) has a long protruding end (not numbered), a short end, a longitudinal slot (241, 251) and a transverse slot (242, 252). The ends of each clutch plate (24, 25) are mounted slidably in the gaps (221) in the annular longitudinal protrusion (22) on the base (21) and the long protruding ends selectively slide into the gaps (291) in the annular longitudinal protrusions (29) on the head (27). A longitudinal slot (241, 251) and a transverse slot (242, 252) are formed in each clutch plate (24, 25) and communicate with each other. The longitudinal slot (241) in the outer clutch plate (24) aligns with the longitudinal slot (251) in the inner clutch plate (25) when the long protruding ends of the clutch plates (24, 25) slide into the gaps (291) in the annular longitudinal protrusions (29) on the head (27). The transverse slot (242) in the outer clutch plate (24) aligns with the transverse slot (252) in the inner clutch plate (25) when the long protruding ends of the clutch plates (24, 25) are retracted into the gaps (221) in the annular longitudinal protrusions (22) on the base (21).

The outer doorknob assembly (10) is attached to the outer surface of the door and has a cover (101), a handle (11), a shaft (12), an optional spring (17), a driving board (13), multiple sockets (15) and a locking bar (14). The cover (101) has an inner surface and an outer surface. The inner surface of the cover (101) is attached to the outer surface of the door. The handle (11) is mounted on the outer surface of the cover (101) and has a lock cylinder (18) inside. The shaft (12) is hollow, is mounted on the inner surface of the cover (101), connects to the lock cylinder in the handle (11) and has an inner surface. The spring (17) is mounted around the shaft (12). The driving board (13) is attached to the inner surface of the shaft (12) and has a non-circular hole (131). The non-circular hole (131) corresponds to the non-circular neck (211) on the base (21). The multiple sockets (15) are formed on the inner surface of the cover (101) near the shaft (12) and respectively have an optional coaxial threaded hole (151). The locking bar (14) is flat and has a middle section, a proximal end and a distal end. The proximal and distal ends and the middle section have flat longitudinal surfaces. The flat longitudinal surfaces of the proximal and distal ends are perpendicular to flat longitudinal surfaces of the middle section. The proximal end of the locking bar (14) is mounted in the non-circular hole (131) in the driving board (13) and connects to the lock cylinder (18). The distal end of the locking bar (14) passes sequentially through the non-circular neck (211) on the base (21), the through hole (231) in the base (21), the transverse holes (242, 252) in the outer and inner clutch plates (24, 25), the through hole (281) in the head (27), the locking tube (26), the through hole (31) in the housing (30) and the rotatable plug (44).

The inner doorknob assembly (50) is attached to the inner surface of the door and has a faceplate (57), a cover (501), multiple screws (58), a handle (51), a control knob (56), a shaft (52), an optional spring (54) and a driving board (53). The faceplate (57) is attached to the inner surface of the door (40) and has a central hole (571), multiple optional through holes (572) and multiple thread holes (573). The central hole (571) is formed through the faceplate (57) and corresponds to the rotatable plug (44). The through holes (572) are formed around the central hole (571) and correspond to the fastening holes (42) in the bolt assembly (40). The thread holes (573) are formed around the central hole (571). The cover (501) has an inner surface, an outer surface and multiple fastening holes (501*a*). The outer surface of the cover (501) is attached to the inner surface of the door and covers the faceplate (57). The fastening holes (501*a*) are formed through the cover (501) and correspond to the thread holes (573) in the faceplate (57). The screws (58) pass respectively through the fastening holes (501*a*) in the cover (501) and the thread holes (573) in the faceplate (57) to fasten the cover (501) on the faceplate (57). The handle (51) is mounted on the inner surface of the cover (501) and has a lock cylinder (59) inside. The lock cylinder (59) connects to the distal end of the locking bar (14). The control knob (56) is mounted on the handle (51) and connects to the lock cylinder in the handle (51). The shaft (52) is hollow, is mounted on the outer surface of the cover (501), connects to the lock cylinder in the handle (51) and has an outer surface. The spring (54) is mounted around the shaft (52). The driving board (53) is attached to the outer surface of the shaft (52) and has a non-circular hole (55). The non-circular hole (55) corresponds to the locking tube (26), and the distal end of the locking bar (14) engages the non-circular hole (55).

Each fastener (16) has a threaded end (161) and an open end. The threaded ends (161) pass respectively through the corresponding fastening holes (33) in the ears (32) and screw respectively into the coaxial threaded holes (151) in the sockets (15). The open end has an inner thread (162) and passes through the corresponding fastening hole (42) in the bolt assembly (40) and the through hole (572) in the faceplate (57). A screw (19) extending through a through hole (572) in the faceplate (57) engages the inner thread (162) of each fastener (16).

Figure 3:
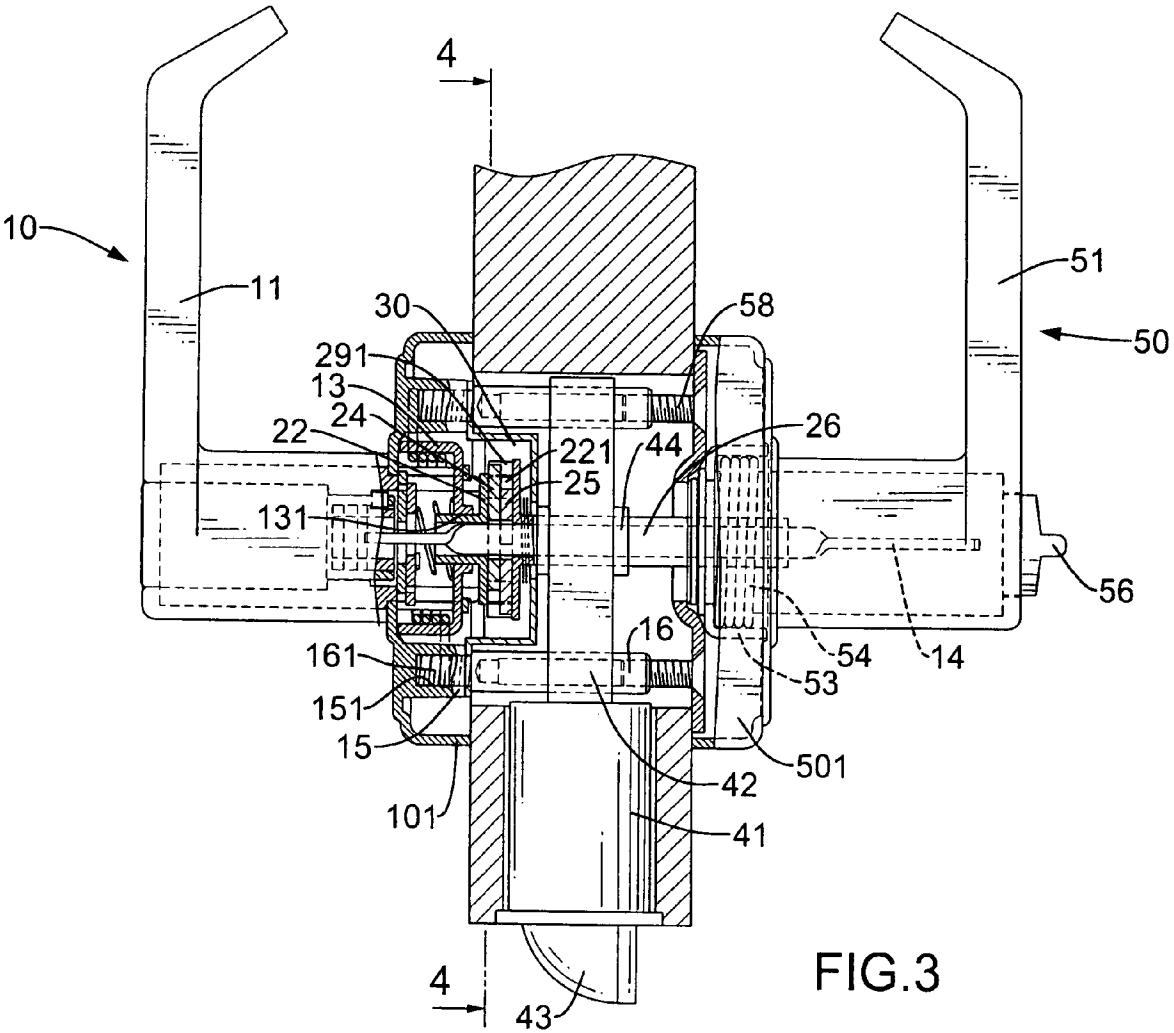
FIG. 3 is a top view in partial section of the doorknob in FIG. 1 when the doorknob lock is unlocked.
Figure 4:
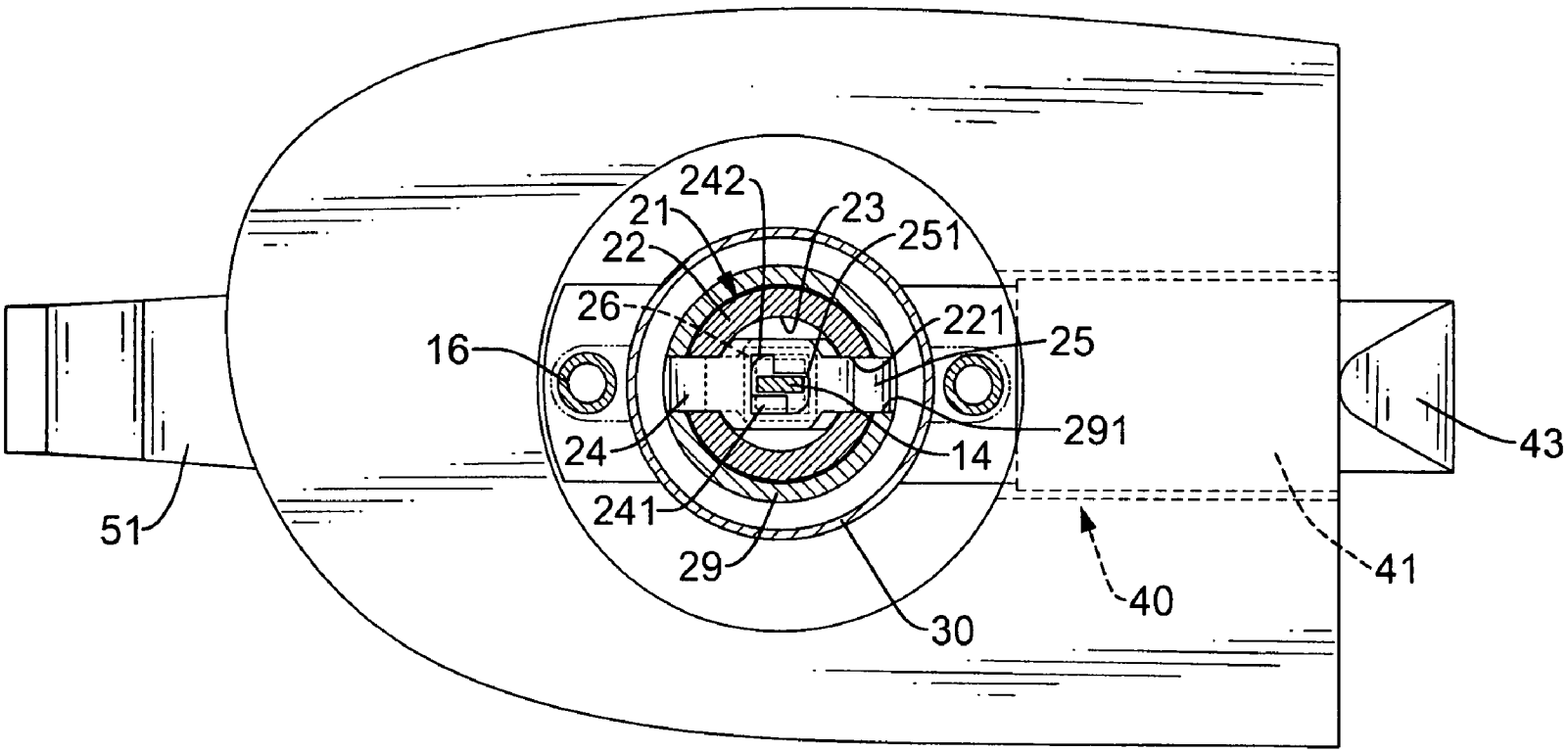
FIG. 4 is a front view in partial section of the doorknob along line 4—4 in FIG. 3 when the doorknob lock is unlocked.

With further reference to FIGS. 3 and 4, the doorknob is unlocked by inserting a proper key or turning the control knob (56) to unlock lock cylinder (18, 59). Then the locking bar (14) is rotated. The middle part of the locking bar (14) passes into the longitudinal slots (241, 251) in the outer and inner clutch plates (24, 25). The long protruding ends of the outer and inner clutch plates (24, 25) slide respectively into the gaps (291) in the annular longitudinal protrusion (29) on the head (27). When the handle (51) of the inner doorknob assembly (50) is rotated, the non-circular hole (55) will rotate the locking tube (26), and the locking tube (26) will rotate the rotatable plug (44). When the rotatable plug (44) rotates, the bolt head (43) is retracted into the door, and the door can be opened. When the handle (11) of the outer doorknob assembly (10) is rotated, the non-circular hole (131) will rotate the neck (211). Because the long protruding ends of the outer and inner clutch plates (24, 25) extend respectively into the gaps (291) in the annular longitudinal protrusion (29) on the head (27), the base (21) will rotate the head (27). Then the door can be opened.

Figure 5:
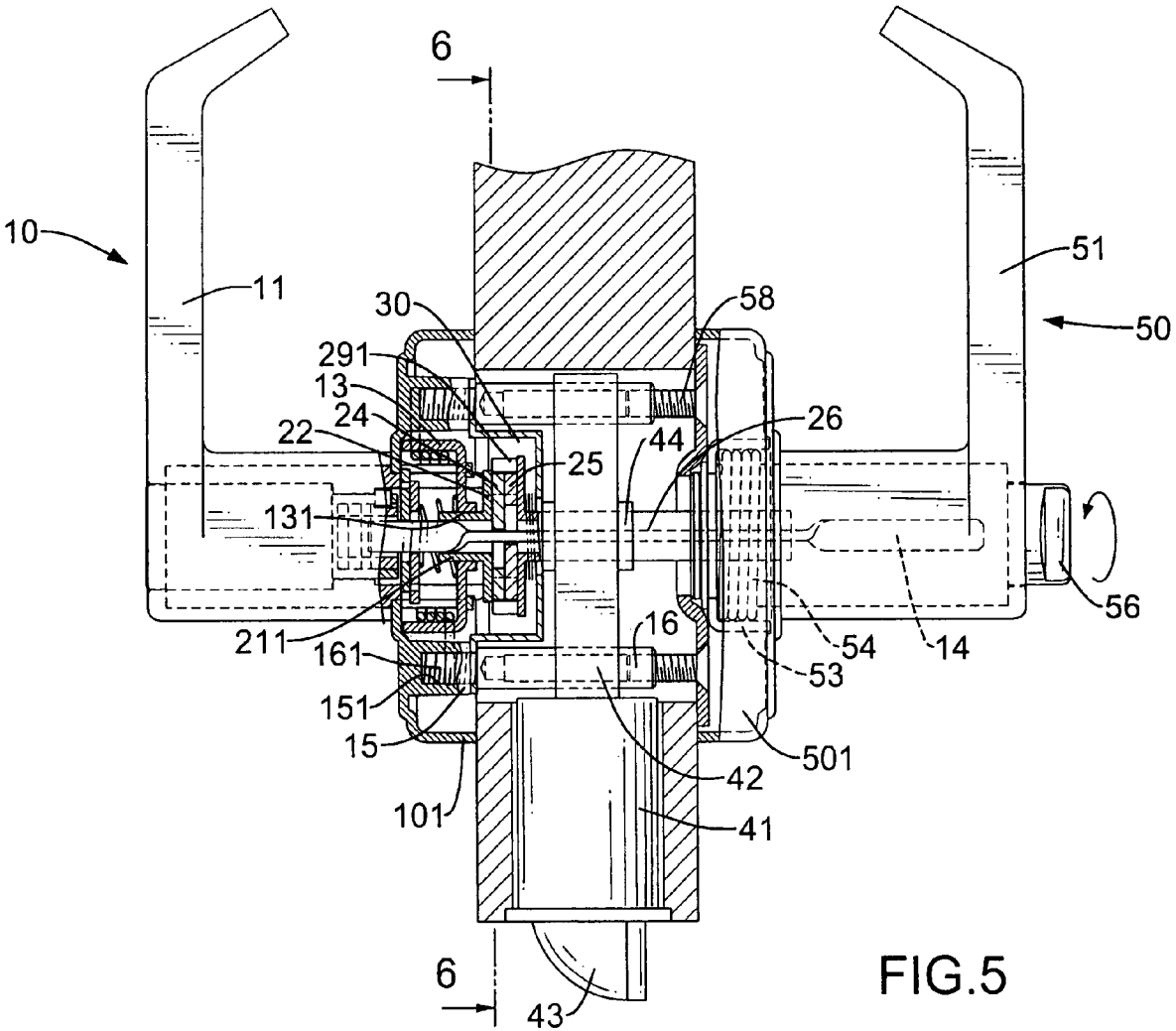
FIG. 5 is a top view in partial section of the doorknob in FIG. 1 when the doorknob lock is locked.
Figure 6:
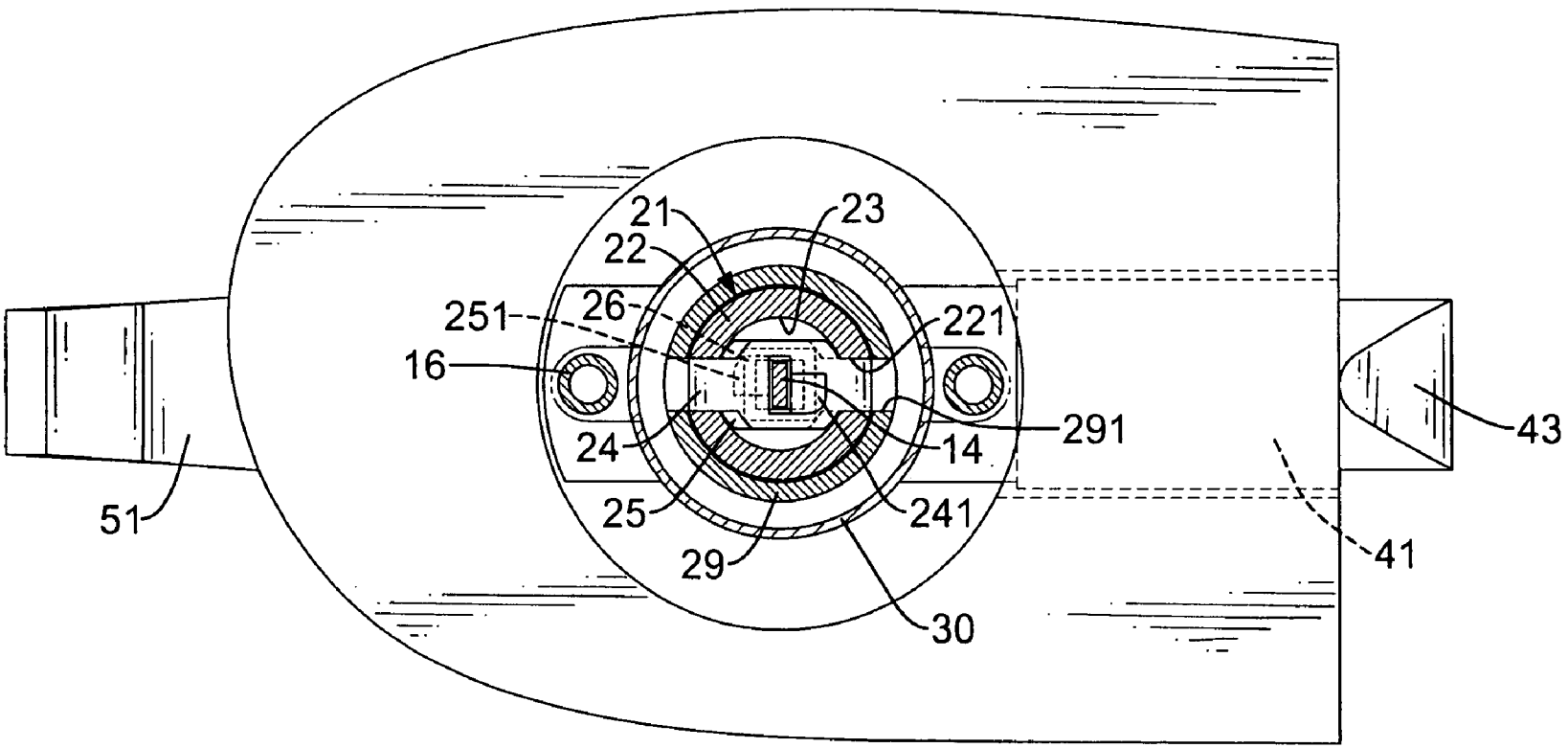
FIG. 6 is a front view in partial section of the doorknob along line 6—6 in FIG. 5 when the doorknob lock is locked.
Figure 7:
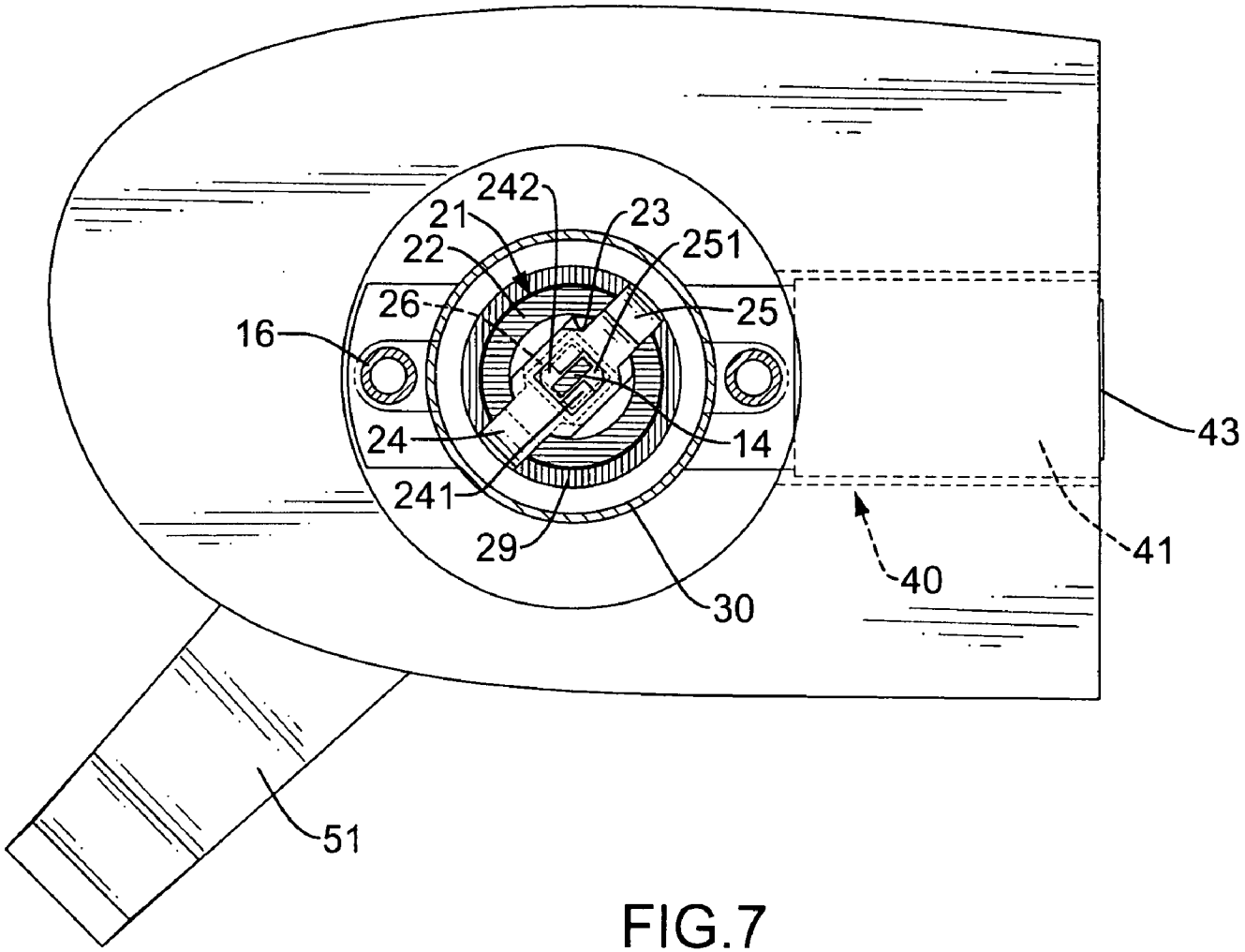
FIG. 7 is an operational front view in partial section of the doorknob lock in FIG. 1 when the doorknob lock is unlocked and an inner handle is turned.

With further reference to FIGS. 5, 6 and 7, the doorknob is locked by inserting the proper key or turning the control knob (56) to lock the lock cylinder (18, 59). Then the locking bar (14) is rotated. The middle section of the locking bar (14) rotates into the transverse slots (242, 252) in the outer and inner clutch plates (24, 25) and draws the long protruding ends of the outer and inner clutch plates (24, 25) respectively out of the gaps (291) in the annular longitudinal protrusion (29) on the head (27). With the long protruding ends of the outer and inner clutch plates (24, 25) disengaged from the gaps (291) in the annular longitudinal protrusion (29) on the head (27), rotating the handle (11) on the outer doorknob assembly (10) will not rotate the locking tube (26), and the door will not open.

However, rotating the handle (51) of the inner doorknob assembly (50) will rotate the locking tube (26) and open the door. When the handle (51) is rotated, the non-circular hole (55) will rotate the locking tube (26), and the locking tube

(26) will rotate the rotatable plug (44). Then the bolt head (43) is retracted into the door, and the door can be opened.

Therefore, the doorknob can be locked by a proper key from outside the door (40) or by turning the control button (56) inside the door. The door can be opened by unlocking the doorknob with the proper key inserted to unlock the lock cylinder (18) and the handle (11) turned from outside the door (40) or by turning the control knob (56) to unlock the lock cylinder (59) and turning the doorknob or simply by turning the handle (51) of the inner doorknob assembly (50). When an emergency is occurs, a child can open the door easily by simply turning the handle (51).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A doorknob with a lock comprising a bolt assembly having a bolt having a distal end and a proximal end;

a bolt head formed in the distal end of the bolt; and a rotatable plug being circular, having a non-circular through hole and mounted rotatably through the bolt near the proximal end of the bolt;

a lock activating assembly connected to the bolt assembly and having a lock activator having a locking tube being non-circular and corresponding to and mounted through the non-circular through hole in the rotatable plug and having a proximal end;

a distal end; and a central through hole; and a head formed on the proximal end of the locking tube and having an outer surface;

an edge;

a through hole formed through the head and corresponding to the central through hole of the locking tube; and an annular longitudinal protrusion formed on the edge and the outer surface of the head, forming an open cavity and having two opposite gaps;

a base corresponding to the open cavity of the head and having an outer surface;

an inner surface;

an edge;

a non-circular neck being hollow and formed concentrically on the outer surface of the base;

a through hole formed through the base and corresponding to the non-circular neck; and an annular longitudinal protrusion formed on the inner surface and the edge of the base, forming an open cavity and having two opposite gaps corresponding to the gaps in the annular longitudinal protrusion of the head;

an outer clutch plate mounted in the open cavity of the base and having a long protruding end mounted slidably in the gaps in the annular longitudinal protrusion on the base and selectively sliding into one of the gaps in the annular longitudinal protrusions on the head;

a short end mounted slidably in one of the gaps in the annular longitudinal protrusion on the base;

a longitudinal slot; and a transverse slot communicating with the longitudinal slot;

an inner clutch plate mounted in the open cavity of the base and having a long protruding end mounted slidably in the gaps in the annular longitudinal protrusion on the base and selectively sliding into one of the gaps in the annular longitudinal protrusion on the head;

a short end mounted slidably in one of the gaps in the annular longitudinal protrusion on the base;

a longitudinal slot; and a transverse slot communicating with the longitudinal slot selectively aligning with the transverse slot in the outer clutch plate;

an outer doorknob assembly connected to the lock activating assembly and having a cover having an inner surface and an outer surface;

a handle mounted on the outer surface of the cover and having a lock cylinder inside;

a shaft being hollow, mounted on the inner surface of the cover, connecting to the lock cylinder in the handle and having an inner surface;

a driving board attached to the inner surface of the shaft and having a non-circular hole corresponding to the non-circular neck on the base; and a locking bar being flat having a middle section with flat longitudinal surfaces;

a proximal end with flat longitudinal surfaces perpendicular to the flat longitudinal surfaces of the middle section, mounted in the non-circular hole in the driving board and connecting to the lock cylinder; and a distal end with flat longitudinal surfaces perpendicular to the flat longitudinal surfaces of the middle section sequentially passing through the non-circular neck on the base, the through hole in the base, the transverse slots in the outer and inner clutch plates, the through hole in the head, the locking tube and the rotatable plug;

an inner doorknob assembly connected to the lock activating assembly and having a faceplate having a central hole corresponding to the rotatable plug;

a cover securely attached to the faceplate having an inner surface; and an outer surface covering the faceplate;

a handle mounted on the inner surface of the cover and having a lock cylinder inside of the handle and connecting to the distal end of the locking bar;

a control knob mounted on the handle and connecting to the lock cylinder in the handle;

a shaft being hollow, mounted on the outer surface of the cover, connecting to the lock cylinder in the handle and having an outer surface; and a driving board attached to the outer surface of the shaft and having a non-circular hole corresponding to the locking tube, and the distal end of the locking bar engaging the non-circular hole.

2. The doorknob as claimed in claim 1, wherein the doorknob further comprises a housing having an inner surface;

an outer surface;

an edge;

a through hole aligning with the non-circular through hole in the rotatable plug; and multiple ears formed on the outer surface and the edge of the housing, being opposite to each other and each ear having a fastening hole formed through the ear and corresponding to one of fastening holes in the bolt assembly; and the lock activator further comprises a spring mounted around the locking tube and compressed by the head and the housing.

3. The doorknob as claimed in claim 1, wherein the outer doorknob assembly further comprises a spring mounted around the shaft; and the inner doorknob assembly further comprises a spring mounted around the shaft.

4. The doorknob as claimed in claim 2, wherein the bolt assembly further comprises multiple fastening holes formed around the rotatable plug;

the driving board of the outer doorknob assembly further has multiple sockets formed on the inner surface of the cover near the shaft and respectively having a coaxial threaded hole;

the faceplate of the inner doorknob assembly further comprises multiple through holes formed around the central hole and corresponding to the fastening holes in the bolt assembly;

multiple fasteners respectively having threaded ends passing respectively through the corresponding fastening holes in the ears of the housing and screwing respectively into the coaxial threaded holes in the sockets; and opening ends respectively having inner threads and passing through the corresponding fastening holes in the bolt assembly and the through holes in the faceplate;

screws extending through a through hole in the faceplate and engaging the inner thread of each fastener.

5. The doorknob as claimed in claim 1, wherein the faceplate of the inner doorknob assembly further has multiple fastening holes formed around the central hole;

the cover of the inner doorknob assembly further has multiple fastening holes formed through the cover and corresponding to the fastening holes in the faceplate; and multiple screws pass respectively through the fastening holes in the cover and in the faceplate to securely attach the cover to the faceplate.

* * * * *